United States Patent [19]

Kokeguchi et al.

[11] 4,403,954

[45] Sep. 13, 1983

[54] APPARATUS FOR HEAT-TREATING PIPES

[75] Inventors: Hitoshi Kokeguchi, Takarazuka; Jiro Yamaguchi, Itami; Akinori Sakoda, Amagasaki; Mikio Umeda, Kawanishi; Tadashi Yamashita, Nishinomiya; Yoshimasa Katsuki, Takarazuka; Mitsuru Murakami, Kobe; Yasuo Imamura, Amagasaki, all of Japan

[73] Assignee: Kubota, Ltd., Osaka, Japan

[21] Appl. No.: 286,369

[22] Filed: Jul. 24, 1981

[30] Foreign Application Priority Data

| | | | |
|---|---|---|---|
| Aug. 8, 1980 | [JP] | Japan | 55-109435 |
| Aug. 8, 1980 | [JP] | Japan | 55-109437 |
| Oct. 13, 1980 | [JP] | Japan | 55-143526 |
| Oct. 13, 1980 | [JP] | Japan | 55-143527 |

[51] Int. Cl.[3] ..... F27B 9/14; F27B 3/04; B65G 15/00; B65G 15/64

[52] U.S. Cl. ..... 432/124; 198/344; 198/345; 432/128; 432/130

[58] Field of Search ..... 432/124, 128, 130, 146; 198/344, 379, 345

[56] References Cited

U.S. PATENT DOCUMENTS

| | | | |
|---|---|---|---|
| 914,188 | 3/1909 | Robinson | 432/124 |
| 2,713,480 | 7/1955 | Ruckstahl | 432/128 |
| 2,795,411 | 6/1957 | Court | 432/124 |
| 3,874,091 | 4/1975 | Fukumoto | 432/146 |
| 3,901,381 | 8/1975 | Quinn | 198/344 |
| 3,915,285 | 10/1975 | Lindquist et al. | 198/344 |

*Primary Examiner*—John J. Camby
*Attorney, Agent, or Firm*—Joseph W. Farley

[57] ABSTRACT

An apparatus for heat-treating pipes comprising a furnace chamber for accommodating a plurality of pipes as arranged in parallel, a chain conveyor disposed in the furnace chamber for transporting the pipes in a direction at right angles to the axes of the pipes, and a plurality of stopper means for stopping the pipes intermittently at suitably spaced-apart positions in the path of transport by the chain conveyor and causing each of the pipes to rotate about its own axis in cooperation with the chain conveyor. Since the pipe is intermittently stopped and rotated about its own axis during heat treatment, the pipe is free of thermal deformation to an elliptical shape. Pipes can be heat-treated in succession in a small space, therefore with a very high efficiency. The motion of the chain conveyor is utilized for rotating the pipe without necessitating any additional device for the rotation.

15 Claims, 10 Drawing Figures

APPARATUS FOR HEAT-TREATING PIPES

The present invention relates to an apparatus for heat-treating pipes, such as cast-iron pipes.

It is known to heat-treat cast-iron pipes by heating the pipes to a predetermined temperature after the pipes have been spontaneously cooled once and subsequently cooling the pipes slowly at a specified rate to obtain the desired ferrite structure. For this heat treatment, continuous annealing furnaces are generally used in which the pipes are passed through a heating zone, soaking zone and slow cooling zone while being transported. However, the slow cooling of pipes requires a considerably long distance and a large space. The large space results in great heat losses, while energy losses are also involved in heating the pipes to the predetermined temperature after spontaneous cooling. On the other hand, batch furnaces, although used, are inefficient.

The main object of the invention is to overcome these problems and to provide a heat-treating furnace by which pipes can be treated efficiently in a small space while being prevented from deforming to an elliptical cross section due to the high treating temperature.

To fulfill this object, the invention provides an apparatus for heat-treating pipes comprising a furnace chamber having an inlet and an outlet and capable of accommodating a plurality of pipes arranged in parallel at a suitable spacing, a plurality of main chains disposed in the furnace chamber and drivingly movable in a direction at right angles to the axes of the pipes for providing a path of transport of the pipes, and a plurality of stopper means for stopping the pipes intermittently at suitably spaced-apart positions in the path of transport and causing each of the pipes to rotate about its own axis in cooperation with the main chains.

According to the arrangement described above, the pipe is brought into engagement with the stopper means at each of its stopped positions, where the pipe is rotated about its own axis by the movement of the main chains. This prevents elliptical deformation of the pipe during the heat treatment. Further since the force of movement of the main chains (generally the conveying force thereof) is utilized for rotating the pipe about its own axis, there is no need to separately supply power only for the rotation of the pipe.

In addition to the foregoing problems, the heat-treatment of pipes involves the following problem. For example, because the weight of the pipe per unit length is not uniform axially thereof, the pipe is liable to move axially thereof while being rotated about its own axis in engagement with the stopper means or the like. Such axial movement or displacement of the pipe may be corrected, for example, by a pusher for pushing the pipe in the axial direction, but if the pipe has a large diameter, the pusher requires a great force. Furthermore, when pushing the pipe in a red-hot state, the pusher is likely to deform the pipe. The pushing method is therefore infeasible. Accordingly it has been the practice to use a furnace of increased width for avoiding the possible damage to the furnace wall by the collision of pipes and to provide an additional chain for preventing the pipe from running off the path. This entails increased heat losses and renders the equipment costly.

According to a preferred embodiment of the present invention, the apparatus further comprises sensor means provided in corresponding relation to each of the stopper means for detecting axial movement of the pipe, and a control provided for the stopper means and operable in response to the sensor means for correcting axial displacement of the pipe.

With this arrangement, the axial displacement of the pipe can be corrected at each of its stopped positions, consequently eliminating the necessity of increasing the width of the furnace or providing an additional chain and therefore assuring savings in heat energy and a reduction in the equipment cost.

Various features and advantages of the present invention will become apparent from the following embodiments described with reference to the accompanying drawings, in which.

Figure 1:
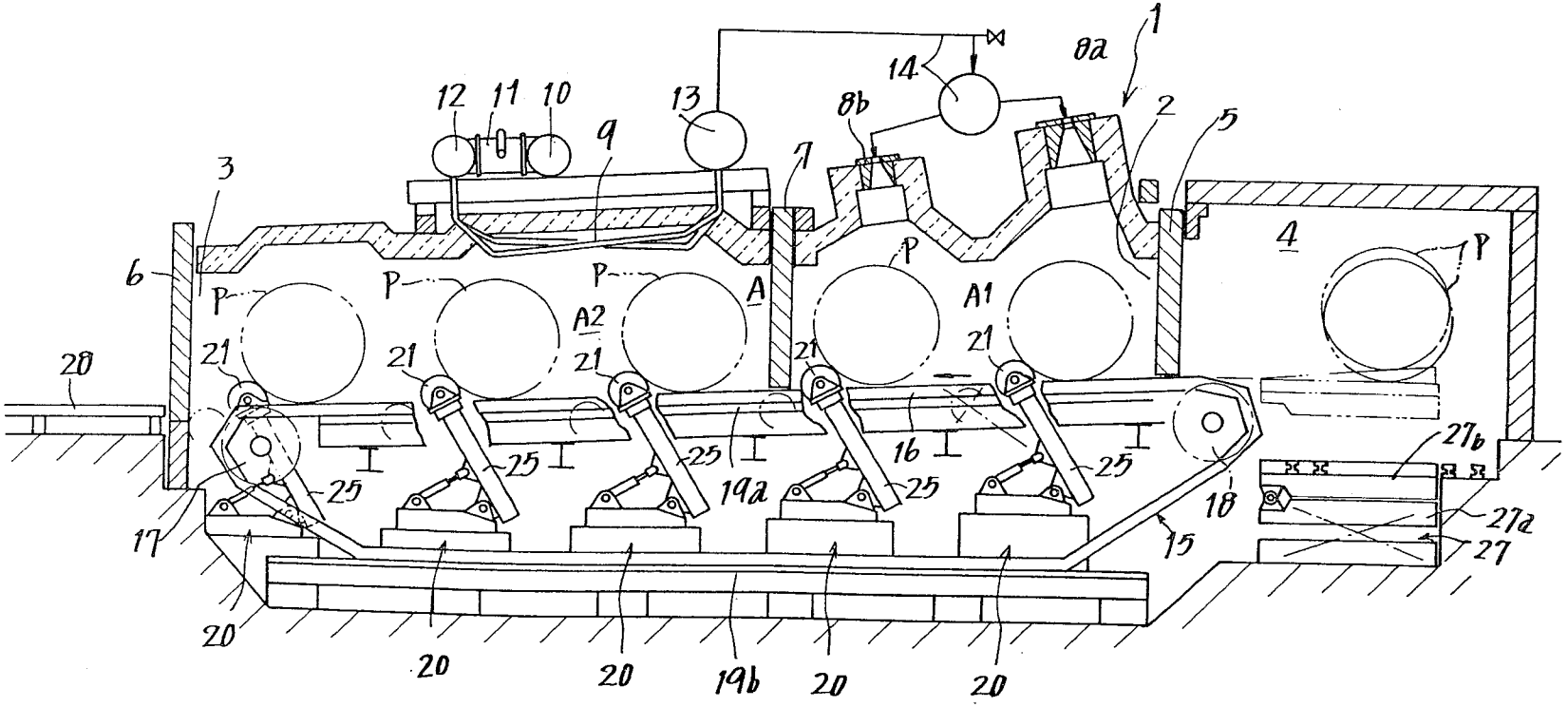
FIG. 1 is an overall side elevation in vertical section showing an apparatus which is a first embodiment of the invention.
Figure 2:
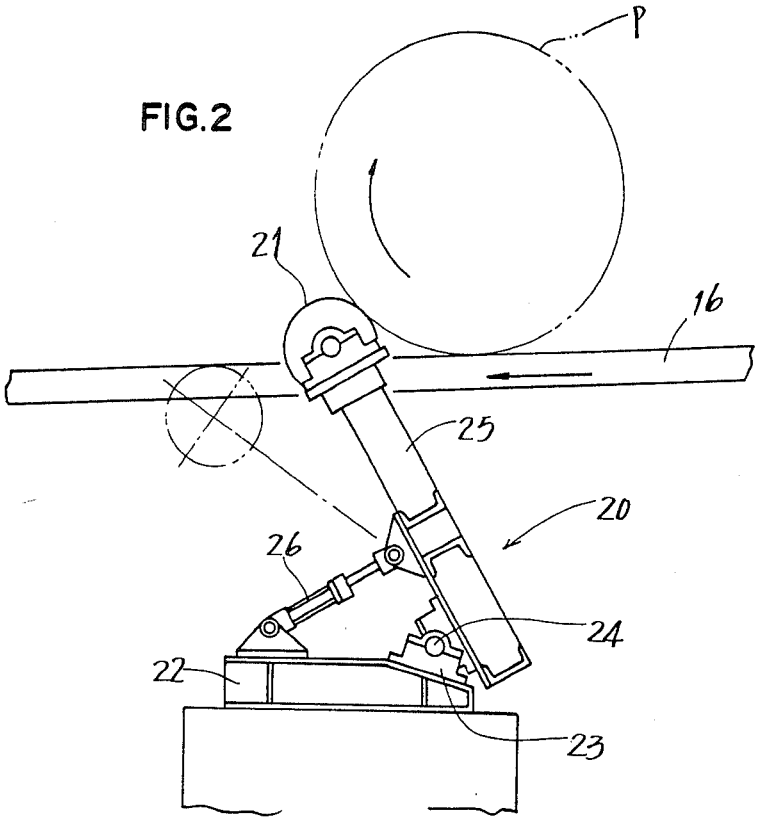
FIG. 2 is a side elevation showing stopper means thereof.

With reference to FIGS. 1 and 2, a furnace 1 has a furnace chamber A capable of accommodating a plurality of (e.g. five as illustrated) pipes P as arranged in parallel at a suitable spacing. The chamber A has an inlet 2 for the pipe P at one end of the parallel arrangement of pipes and an outlet 3 for the pipe at the outer end thereof. A chamber 4 for feeding the pipe P is adjacent the inlet 2. A pipe P as withdrawn in a red-hot state from the rotary die of an unillustrated centrifugal casting machine is brought into the feed chamber 4 and retained therein while being prevented from cooling before being fed into the furnace chamber A. A liftable door 5 is provided between the inlet 2 and the feed chamber 4, and a liftable door 6 is disposed at the outlet 3. The furnace chamber A further has an intermediate liftable door 7 at an intermediate location of the parallel pipe arrangement. The furnace chamber A is divided by the intermediate door 7 into a heating chamber A1 at the inlet side and a slow cooling chamber A2. Heat-insulating curtains are usable in place of the doors 5 to 7.

Mounted on the upper wall of the furnace 1 are burners 8*a* and 8*b* positioned in the heating chamber A1 above the arrangement of pipes P for directly heating the top of the pipe P with a high-temperature gas to a predetermined temperature. Cooling pipes 9 are disposed in an upper portion of the slow cooling chamber A2 closer to the heating chamber A1 for efficiently cooling the pipe P at a rate within a predetermined range. Through a damper 11 and a distributing header 12, cooling air is supplied to the cooling pipes 9 from a blower 10 mounted on the furnace 1. The air is heated while passing through the cooling pipes 9 and sent via a collecting header 13 and an air duct 14 to the burners 8*a* and 8*b* as combustion air.

At a lower portion of the furnace chamber A, a chain conveyor 15 travels for transporting pipes P from the inlet 2 to the outlet 3 and rotating each of the pipes P about its own axis. The chain conveyor 15 comprises a plurality of endless main chains 16 arranged side by side axially of the pipe P at a suitable spacing for transporting pipes P on their outer peripheries. Indicated at 17 are drive sprockets at the outlet 3, at 18 driven sprockets at the inlet 2 and at 19*a*, 19*b* upper and lower chain guide rails, respectively.

Stopper means 20 are arranged at a suitable spacing in the direction of transport of pipes by the chain conveyor 15. Each of the stopper means 20 has a set of rollers 21 spaced apart axially of the pipe P and upwardly movable into the path of transport of pipes by the chain conveyor 15 to engage the pipe P, the set of rollers being downwardly movable from the engaging position to a retracted position below the path. Thus each of the illustrated pipes P is rotatably supported on the chain conveyor 15 when stopped by the set of rollers 21 in their engaging position. With the travel of the main chains 16, the pipe P is rotated about its own axis in the stopped or engaged position.

As shown in FIG. 2, each of the stopper means 20 comprises a pivotable frame 25 turnably supported at its lower end by horizontal pivots 24 on bearings 23 at one end of a fixed base 22, the above-mentioned rollers 21 are rotatably mounted on the upper end of the pivotable frame 25, and a cylinder assembly 26 interconnects an intermediate portion of the pivotable frame 25 and the other end of the base 22 for turning the pivotable frame 25. The rollers 21 are moved into or out of the path of transport of the pipe P by the extension or contraction of the cylinder assembly 26.

A lifter 27 of the pantograph type disposed at a lower portion of the feed chamber 4 includes a lifting support 27*a* and a tiltable frame 27*b* on the support 27*a*. A pipe P withdrawn from the rotary die is placed onto the tiltable frame 27*b* in its lowered position. To feed the pipe P into the furnace chamber A, the tiltable frame 27*b* is raised by the support 27*a* to the level of the path of transport on the chain conveyor 15 as shown in broken lines in FIG. 1 and is therefore tilted to cause the pipe P to roll into the chamber A. Indicated at 28 is a delivery guide adjacent the outlet 3. When the path of transport provided by the chain conveyor 15 is slightly inclined as illustrated, the pipe P will roll along the path during transport.

The apparatus operates in the following manner. For the heat treatment of pipes P, the chain conveyor 15 is driven in the direction of arrow shown at all times. With the rollers 21 of the stopper means 20 projected into the path of transport on the chain conveyor 15, the liftable door 5 is raised, and the pipe P in the feed chamber 4 is fed to the furnace chamber A through the inlet 2 by the lifter 27, whereupon the door 5 is closed. The pipe P is transported by rolling by itself and also by the chain conveyor 15, and is stopped by engagement with the set of roller 21 in a first position. In this stopped position, the pipe is rotated about its own axis by the travel of the main chains 16 while being heated at its top portion to a specific temperature directly by the burners 8*a* thereabove. Although the pipe P becomes easily deformable by the rise of temperature due to the heating, elliptical deformation of the pipe P is prevented by the rotation.

Upon lapse of a predetermined period of time, the stopper means 20 are operated to retract the rollers 21 from the path of transport for a short period of time. The rollers 21 are thereafter projected to the engaging position again. In the meantime, the pipe P is transferred to a second position into engagement with the rollers 21 of the stopper means 20 in this position by the travel of the chain conveyor 15 and also by rolling. In the same manner as above, the pipe P, while rotating about its own axis, is heated by the burners 8*b* and maintained at a specified temperature for a specified period of time.

The intermediate door 7 is thereafter lifted, and the rollers 21 are retracted from the path for a short period of time again. The pipe P is transported from the heating chamber A1 to a third position in the slow cooling chamber A2, where the pipe is engaged by another set of rollers 21 and cooled for a specified period of time while rotatating about its own axis.

Subsequently the pipe P is similarly cooled at fourth and fifth engaged positions while rotating about its own axis and is thereafter delivered from the outlet 3 onto the delivery guide 28 on completion of heat treatment. Although the heat treatment has been described above stepwise only for one pipe P to simplify the description, a plurality of pipes are of course heat-treated continuously in succession in practice.

Figure 5:
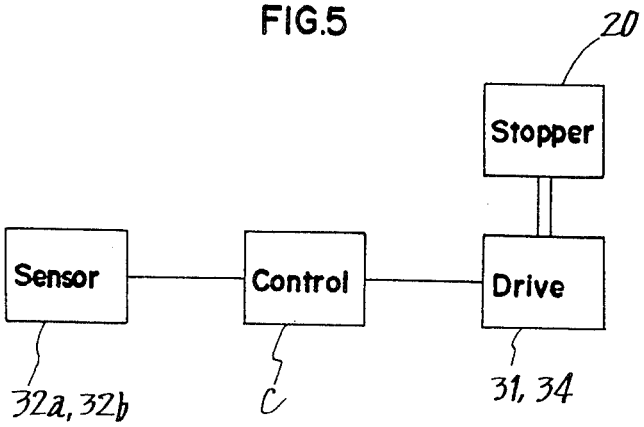
FIG. 5 is a block diagram showing a system for controlling the stopper means.
Figure 3:
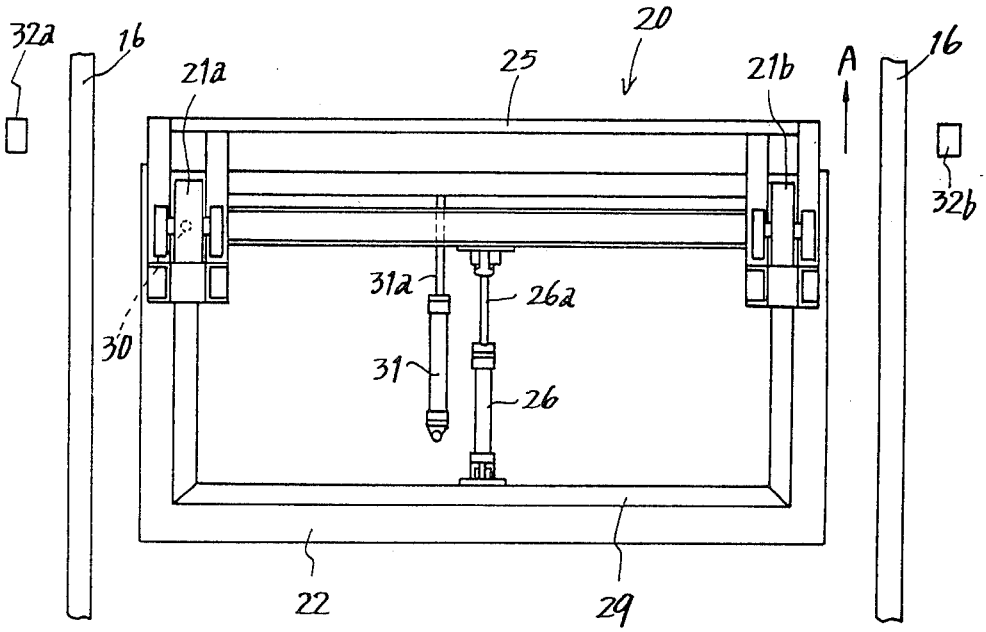
FIG. 3 is a plan view showing a modification of the stopper means.
Figure 4:
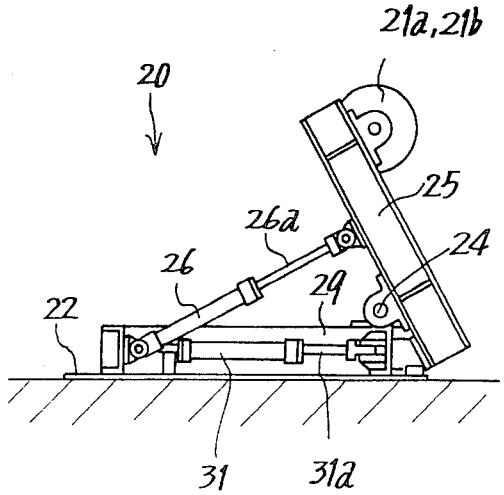
FIG. 4 is a side elevation of the same.

FIGS. 3 and 4 show a modification of the stopper means provided with an expedient for correcting the axial displacement of the pipe. In this modification, the pivotable frame 25 is supported by horizontal pivots 24 on a second frame 29 which is slidable on a fixed base 22. The second frame 29 is turnably mounted on a vertical rod 30 upstanding from the fixed base 22 and positioned closer to one of the main chains 16. A second cylinder assembly 31 is attached at its base end to the fixed base 22 and has a piston rod 31*a* with its forward end attached to the second frame 29. When the piston rod 31*a* of the second cylinder assembly 31 is extended or retracted, the second frame 29 turns about the vertical rod 30 in a horizontal plane. Sensors 32*a*, 32*b* for detecting the axial movement of the pipe P are electrically connected to a circuit c (FIG. 5) for controlling the second cylinder assembly 31. Throughout FIGS. 1 to 4, et seq. like parts serving the same functions despite some differences are referred to by like reference numerals.

The axial displacement of the pipe is corrected by the modified stopper means 20 in the following manner. When the pipe P in one of the engaged or stopped positions moves more than a certain distance axially thereof, the pipe P comes into contact with the sensor 32*a* or 32*b* to actuate that sensor. Assuming that the pipe P has moved, for example, rightward in FIG. 3, actuating the sensor 32*b*, a signal from the sensor 32*b* is fed to the control circuit c, which controls the second cylinder assembly 31 to extend its piston rod 31*a*, turning the second frame 29 about the vertical rod 30 in the direction of arrow A in FIG. 3 through a specified angle. This shifts the position of the contact of a roller 21*b* with the pipe P in a direction opposite to the direction of transport of the pipe to correct the axial displacement of the pipe P. If the pipe P moves leftward in FIG. 3, the piston rod 31*a* of the second cylinder assembly 31 retracts, shifting the position of the contact of the roller 21*b* with the pipe P in the pipe transport direction to correct the axial displacement of the pipe P.

While the axial displacement of the pipe is corrected by turning this second frame 29 about the vertical rod 30 in the case of the modified stopper means 20 described, the first pivotable frame 25 may be replaced by a plurality of (usually two) pivotable arms which are each provided with a roller at the free end and which are turnable by separate cylinder assemblies individually to correct the axial displacement of the pipe.

Figure 6:
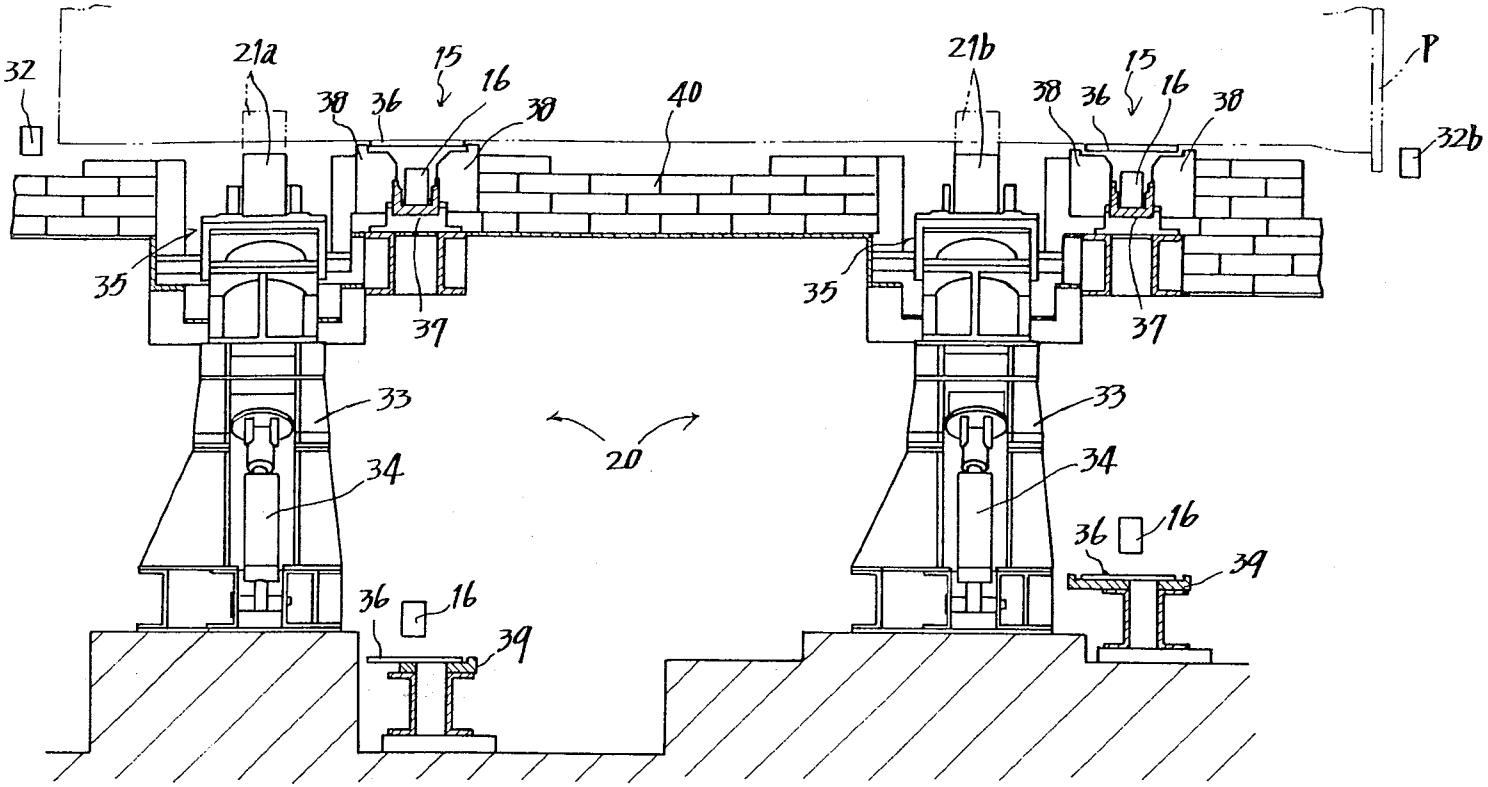
FIG. 6 is a front view showing another modification of the stopper means.
Figure 7:
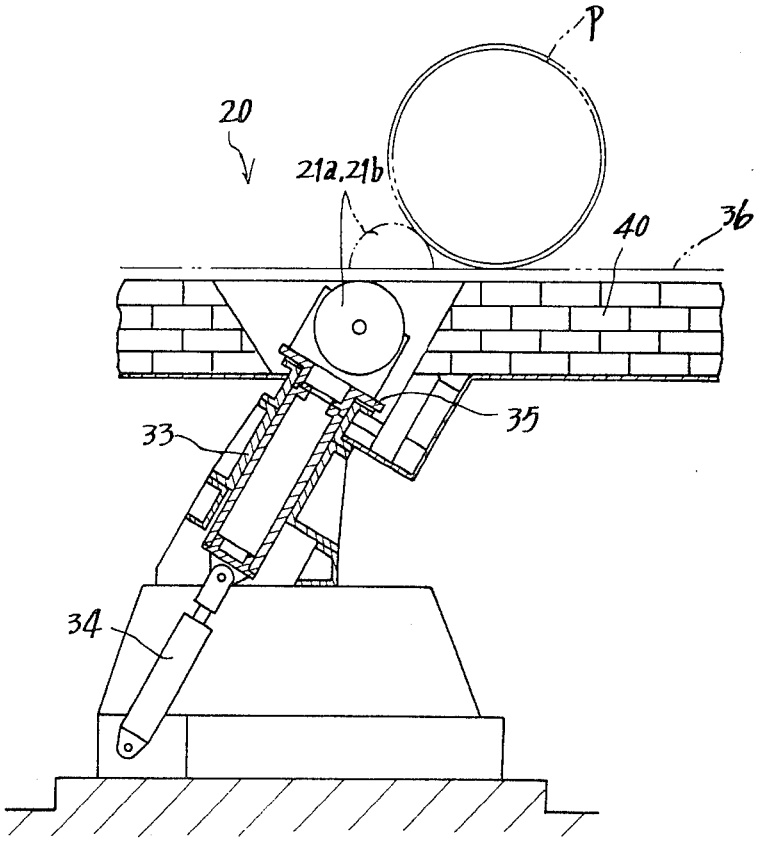
FIG. 7 is a side elevation showing the same partly in section.

Although the rollers 21 of the stopper means 20 shown in FIGS. 1 to 4 are pivotally movable into or out of the path of transport, FIGS. 6 and 7 show another modified stopper means 20 having rollers which are linearly movable. In this case, each of rollrs 21*a*, 21*b* is mounted on the forward end of a support member 35 fitted in a guide member 33 and upwardly or downwardly movable along a direction inclined with respect to the vertical by a drive assembly 34, such as an electric jack. The drive assemblies 34 are coupled via a control circuit c (FIG. 5) to sensors 32*a*, 32*b* for detecting the axial displacement of the pipe.

The axial displacement of the pipe is corrected by the stopper means 20 substantially in the same manner as by the one shown in FIGS. 3 and 4. When the pipe P touches the sensor 32*b* with the rollers 21*a*, 21*b* in engagement with the pipe P, the roller 21*b* is further projected by the corresponding drive assembly 34 for correcting the axial displacement. When the pipe touches the sensor 32*a*, the roller 21*a* is similarly moved for correction. The position of the pipe can of course be corrected by lowering one of the rollers 21*a*, 21*b*, or by lowering one roller and raising the other roller, instead of raising one of the rollers.

Since the arrangement of the lower portion of the furnace chamber is not shown in detail in FIGS. 1 to 4, the arrangement will be described with reference to FIGS. 6 and 7. Slats 36 are attached to the endless main chain 16 by unillustrated members. The slats 36 actually provide a surface for transporting the pipe thereon. The main chain 16 is guided with a guide 37, and the slats 36 with guides 38, 39. The furnace chamber A is divided into upper and lower portions by a partition wall 40 made of refractory bricks or the like, whereby heat losses in the furnace chamber can be prevented.

Figure 8:
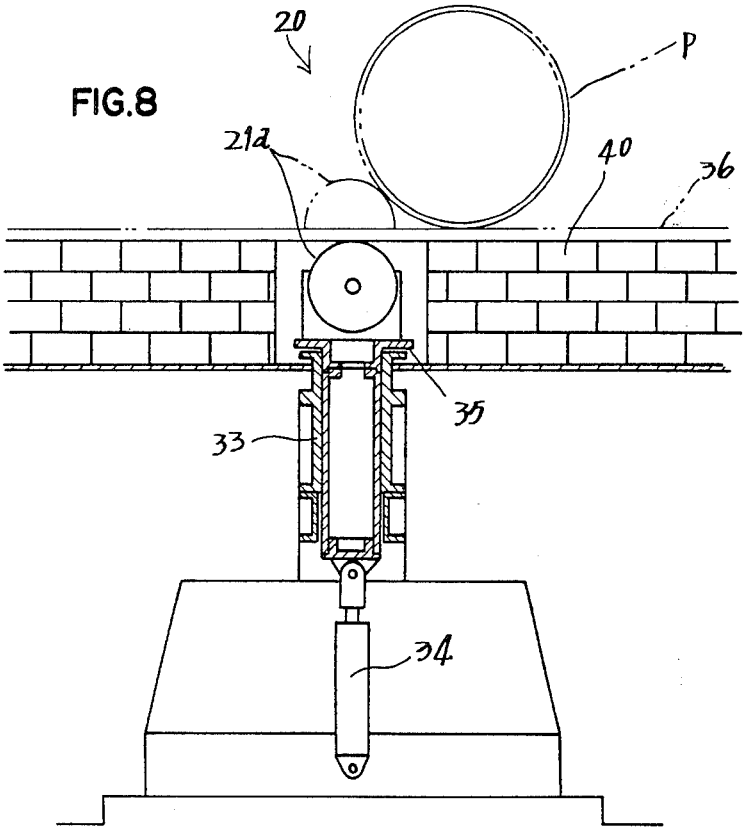
FIG. 8 is a side elevation partly in section and showing another modification of the stopper means.

FIG. 8 shows still another modification of the stopper means which has the same construction as the one shown in FIGS. 6 and 7 except that rollers 21*a*, 21*b* are vertically movable instead of being obliquely movable. This modification is advantageous in that the space in the partition wall 40 around the stopper means 20 can be sealed easily.

Figure 9:
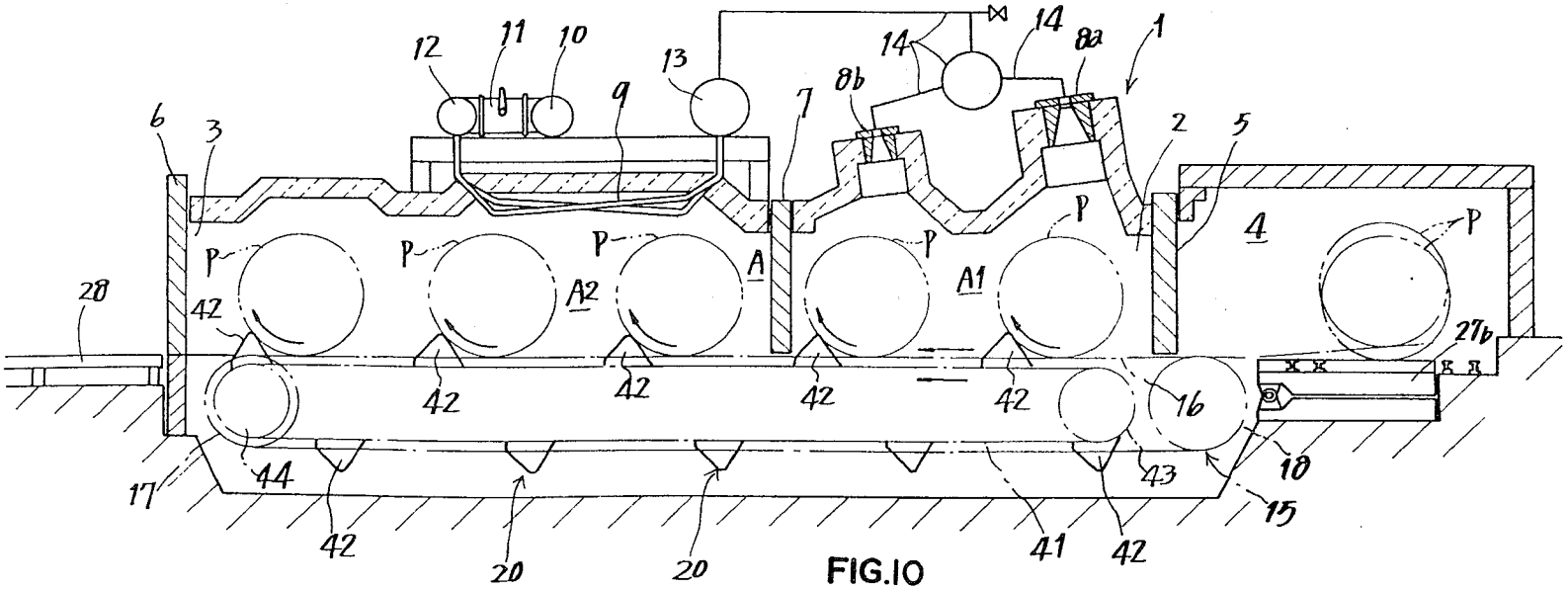
FIG. 9 is an overall side elevation in vertical section showing an apparatus which is a second embodiment of the invention.
Figure 10:
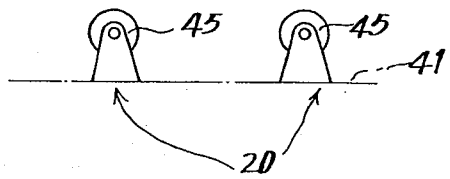
FIG. 10 is a side elevation showing modified engaging portions of stopper means thereof.

A second embodiment of the invention will now be described with reference to FIGS. 9 and 10. In this embodiment, stopper means 20 comprise projections 42 attached to a plurality of auxiliary chains 41 extending parallel to main chains 16, the projections 42 being arranged in the direction of transport of pipes at a suitable spacing. Each of the stopper means 20 includes a set of projections 42 aligned axially of the pipe. Each of the auxiliary chains 41 is reeved around a drive sprocket 43 disposed in the vicinity of a furnace chamber inlet 2 and a driven sprocket 44 provided close to a furnace chamber outlet 3, and is driven in the direction of transport of the pipe P intermittently at a predetermined time interval. The auxiliary chain 41 is moved each time by a distance corresponding to the pitch of the projections 42. The projections 42 are of course replaceable by rollers 45 as shown in FIG. 10 to reduce the frictional resistance involved.

In the case of the present embodiment, pipes P are transported by driving the main chains 16 and auxiliary chains 41 in the direction of arrows. The pipe P can be rotated about its own axis by continuously driving the main chains in the direction of arrow while holding the auxiliary chains 41 in a stopped position, i.e. holding the pipe P in engagement with the aligned projections 42 or rollers 45. Conversely it is possible to drive the main chains 16 from the outlet 3 toward the inlet 2 and transport the pipe P by the auxiliary chains 41, with the projections 42 or rollers 45 thereon in engagement with the pipe P on the rear side thereof with respect to the direction of transport. In this case, the auxiliary chains 41 must have a length equal to or larger than the length of the main chains 16.

Although the furnace chambers A of the foregoing embodiments are divided into a heating chamber A1 and a slow cooling chamber A2 which have two and three stopped positions, respectively, the furnace chamber A need not always be so divided depending on the composition of the pipe, casting conditions, etc., while the number of stopped positions is variable as desired.

What is claimed is:

1. An apparatus for heat-treating pipes comprising a furnace chamber having an inlet and an outlet and capable of accomodating a plurality of pipes arranged in parallel at suitable spacing, a plurality of main chains disposed in the furnace chamber and drivingly movable in a direction at right angles to the axes of the pipes for providing a path of transport of the pipes, a plurality of means for stopping the pipes intermittently at suitably spaced-apart positions in the path of transport to cause them to rotate about their own axes in cooperation with the main chains and for correcting the axial displacement of the pipes, and sensor means provided in corresponding relation to each of the stopping and correcting means for detecting the axial displacement of a corresponding pipe to control the stopping and correcting means so that the pipe is brought to a specified axial position on the path of transport.

2. An apparatus as defined in claim 1 wherein each of the stopping and correcting means comprises a pivotable frame having a base end supported by horizontal pivots, a plurality of rollers mounted on the free end of the pivotable frame, and means for moving the rollers into or out of the path of transport by pivoting the frame.

3. An apparatus as defined in claim 2 wherein the horizontal pivots are attached to a frame member turnably supported by a vertical rod on a fixed base and slidable on the fixed base.

4. An apparatus as defined in claim 3 which further comprises means controlled by the sensor means for turning the frame member about the vertical rod, whereby axial displacement of the pipe is corrected.

5. An apparatus as defined in claim 1 wherein each of the stopping and correcting means comprises a plurality of rollers spaced apart axially of the pipe, and means for moving the rollers linearly into or out of the path of transport.

6. An apparatus as defined in claim 5 wherein the roller moving means are provided for the rollers individually and each comprises guide member disposed below the path of transport, a slider fitting in the guide member and supporting the roller on its one end, and a drive assembly connected to the other end of the slider.

7. An apparatus as defined in claim 6 wherein the amounts of projection of the rollers of each stopping and correcting means are individually controlled in response to the corresponding sensor means to correct axial displacement of the pipe in transport.

8. An apparatus as defined in claim 1 wherein a feed chamber is opposed to the inlet for accommodating the pipe to be fed to the furnace chamber.

9. An apparatus as defined in claim 1 wherein partition means is provided for dividing the furnace chamber into a heating zone and a slow cooling zone.

10. An apparatus as defined in claim 9 wherein the partition means is a liftable door provided between the inlet and the outlet.

11. An apparatus as defined in claim 9 wherein the partition means is a heat-insulating curtain provided between the inlet and the outlet.

12. An apparatus as defined in claim 1 or 9 wherein each of the inlet and the outlet is provided with closure means.

13. An apparatus as defined in claim 12 wherein the closure means comprises a liftable door and/or a heat-insulating curtain.

14. An apparatus as defined in claim 1 wherein burners are provided at the inlet side of the furnace chamber for radiating heat toward the top of the pipe.

15. An apparatus as defined in claim 14 wherein means is provided for supplying to the burners air subjected to heat exchange at the outlet side of the furnace chamber.

* * * * *

UNITED STATES PATENT AND TRADEMARK OFFICE

CERTIFICATE OF CORRECTION

PATENT NO. : 4,403,954

DATED : September 13, 1983

INVENTOR(S) : HITOSHI KOKEGUCHI ET AL

It is certified that error appears in the above—identified patent and that said Letters Patent is hereby corrected as shown below:

Column 2, line 41, "outer" should read -- other --.

Column 5, line 37, "with" should read -- by --.

line 38, "with" should read -- by --.

Column 6, line 62, after "comprises" insert -- a --.

Signed and Sealed this

*Twenty-fourth* Day of *January 1984*

[SEAL]

*Attest:*

GERALD J. MOSSINGHOFF

*Attesting Officer*

*Commissioner of Patents and Trademarks*